US005348503A

United States Patent [19]

Fechtner

[11] Patent Number: 5,348,503

[45] Date of Patent: Sep. 20, 1994

[54] UNDERWATER PADDLE AND VERTICAL FIN FOR SWIMMER

[76] Inventor: Ryszard Fechtner, 8748 Jade Ct., Boynton Beach, Fla. 33437

[21] Appl. No.: 140,321

[22] Filed: Oct. 22, 1993

[51] Int. Cl.[5] ..... A63B 31/10

[52] U.S. Cl. ..... 441/56; 440/15; 440/101; 441/61

[58] Field of Search ..... 440/15, 21, 101; 441/55, 56, 60, 61; 416/70 R

[56] References Cited

U.S. PATENT DOCUMENTS

| | | | |
|---|---|---|---|
| 1,530,560 | 3/1925 | Heminger | 9/21 |
| 2,948,255 | 8/1960 | Sbrana | 440/21 |
| 3,086,492 | 4/1963 | Holley | 440/15 |
| 3,510,894 | 1/1969 | Eriksen | 9/307 |
| 3,557,397 | 1/1971 | Margolies | 9/305 |
| 3,934,290 | 1/1976 | Le Vasseur | 9/309 |
| 3,987,509 | 10/1976 | Patterman | 9/309 |
| 4,541,810 | 9/1985 | Wenzel | 441/64 |
| 4,781,637 | 11/1988 | Caires | 441/61 |
| 4,820,216 | 4/1989 | Masters | 440/101 |
| 4,832,631 | 5/1989 | Gag | 440/26 |
| 4,857,024 | 8/1989 | Evans | 441/64 |
| 5,114,371 | 5/1992 | Alonzo | 440/26 |

FOREIGN PATENT DOCUMENTS

| | | | |
|---|---|---|---|
| 0757954 | 5/1967 | Canada | 441/56 |
| 0512096 | 6/1957 | Italy | 444/55 |
| 0188872 | 11/1966 | U.S.S.R. | 441/55 |

*Primary Examiner*—Sherman Basinger
*Attorney, Agent, or Firm*—Alvin S. Blum

[57] ABSTRACT

A swimming aid includes a paddle with two blades for alternating arm strokes and a vertical blade attached to both feet for side to side leg motion in cooperation with the arm strokes. The two paddle blades are at opposite ends of a hand held shaft. Each blade has a rigid leading edge and a flexible following portion. When pushed forward, the blade lies in a plane for minimal hydrodynamic resistance. When pulled backward on a power stroke, the following portion bends out of the plane, creating increased hydrodynamic resistance for enhanced forward propulsion. This pulling action causes the legs to move laterally, alternating from side to side as the arm strokes alternate. A vertical blade has a narrow anterior portion with foot pockets for both feet side by side. The blade is widest at its trailing edge which may be forked and acts like a fish tail fin forcing the body forward. The propulsion is provided by the torso muscles moving the legs side to side not by leg muscles kicking as in swim fins.

20 Claims, 3 Drawing Sheets

FIG. 11
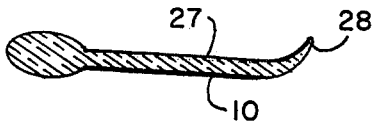
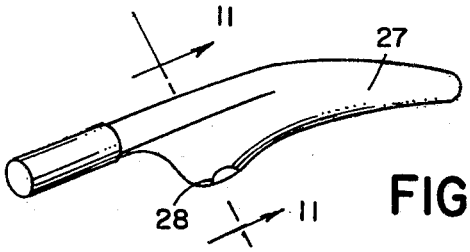
FIG. 10
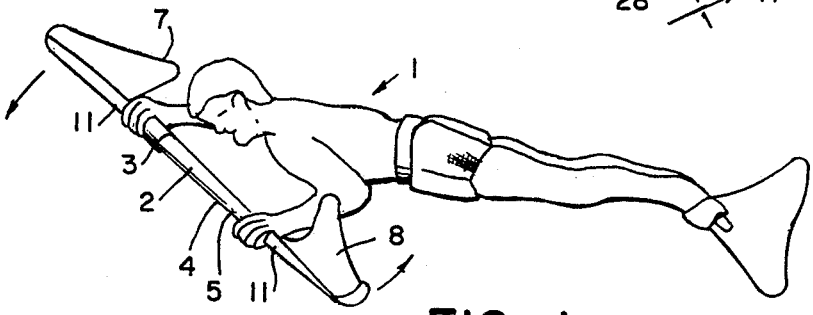
FIG. 1
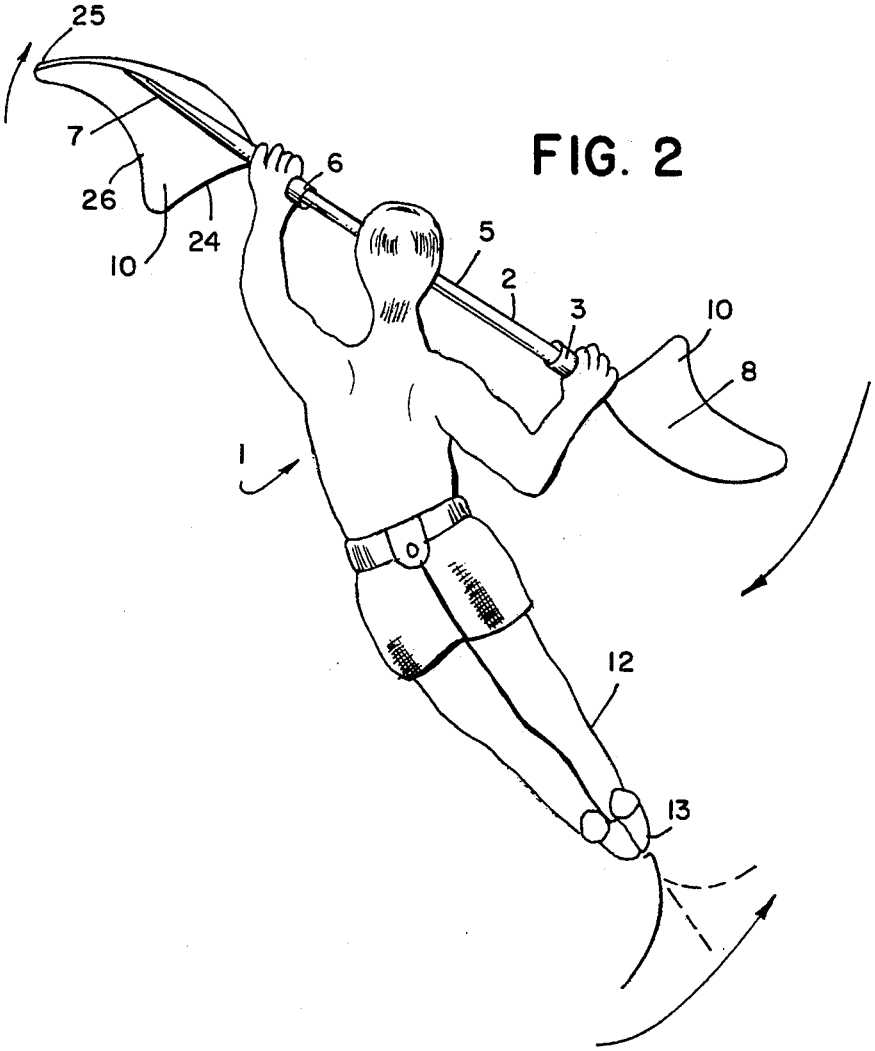
FIG. 2

FIG. 3
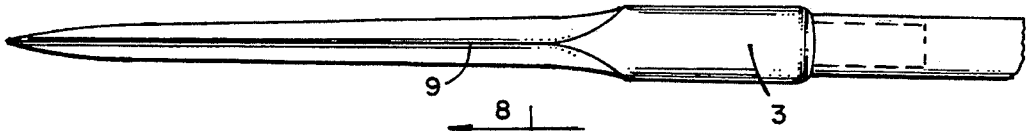
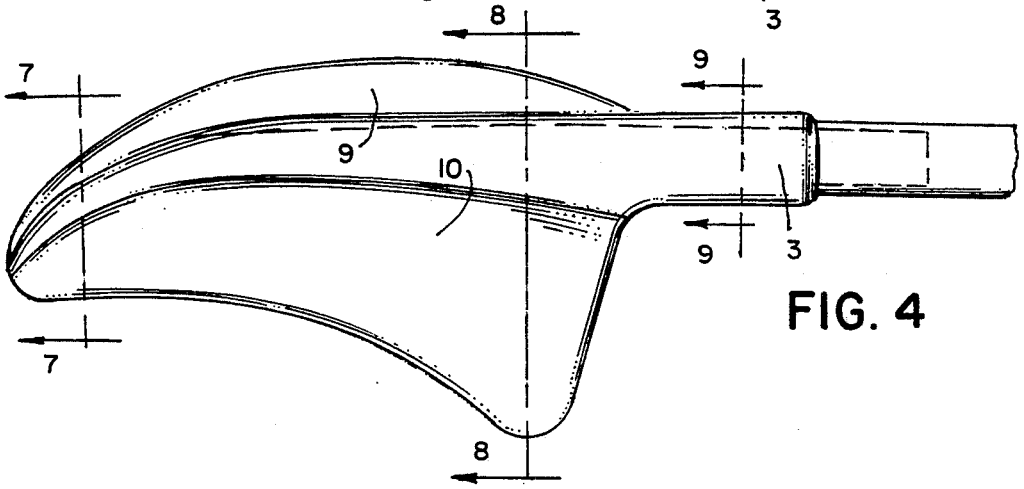
FIG. 4
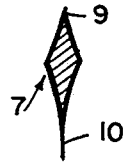
FIG. 7
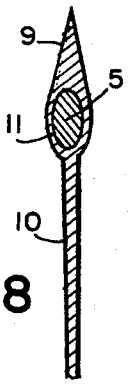
FIG. 8
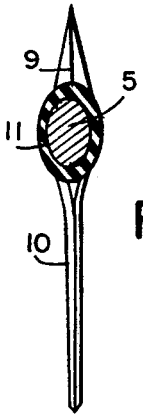
FIG. 9
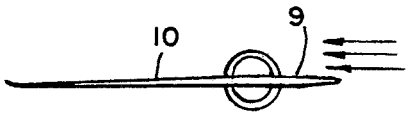
FIG. 5A
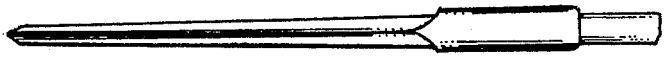
FIG. 6A
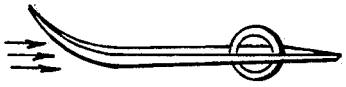
FIG. 5B
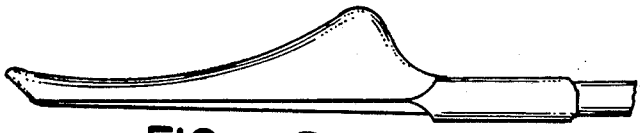
FIG. 6B
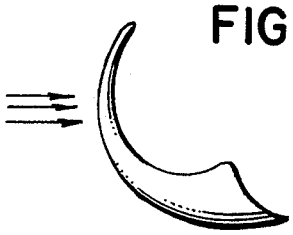
FIG. 5C
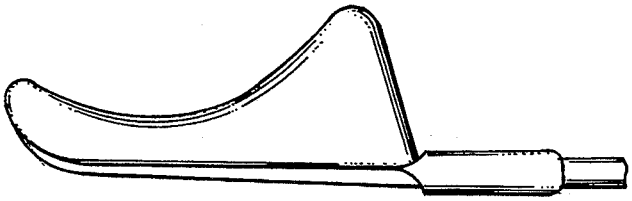
FIG. 6C FIG. 12
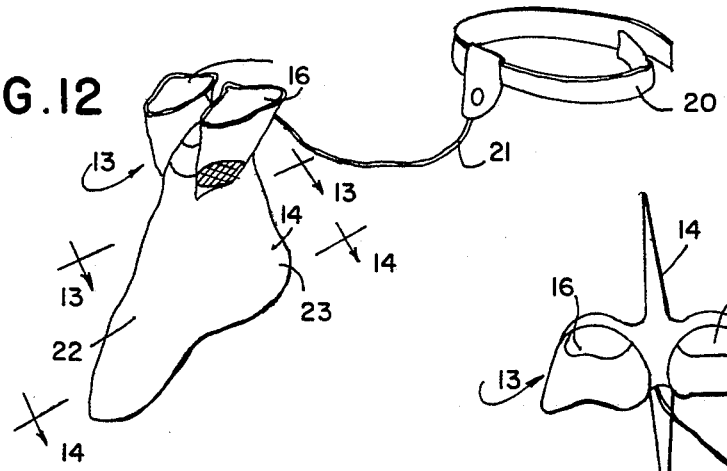
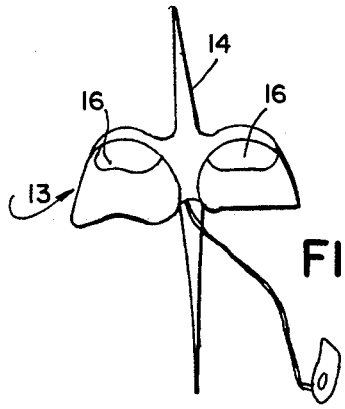
FIG. 15
FIG. 13
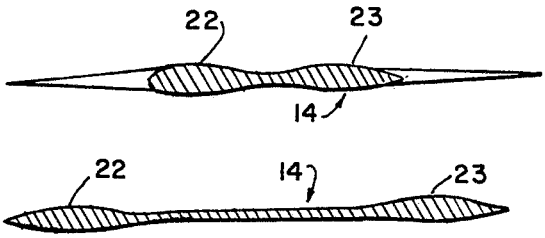
FIG. 14
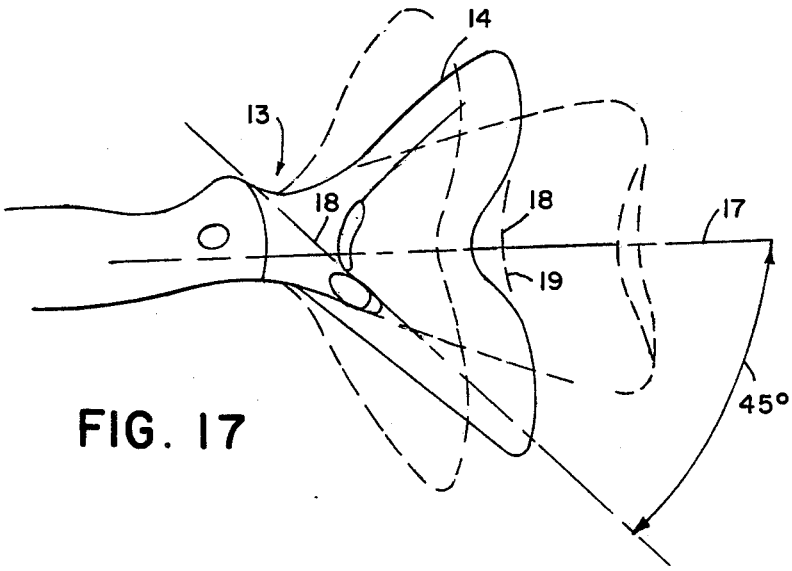
FIG. 17
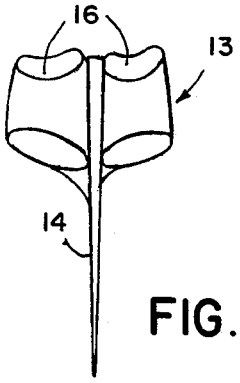
FIG. 16

UNDERWATER PADDLE AND VERTICAL FIN FOR SWIMMER

BACKGROUND OF THE INVENTION

This invention relates to hand and foot operated swimming aids, and more particularly to a manually powered underwater paddle and a single vertical, feet attached fin, whose combined operations are enhanced by a swimmer's normal body motion.

Double bladed paddles are well known for propulsion of kayaks and canoes. They have a shaft to be held by two hands with a blade at each end of the shaft. The shaft is held at an angle to the horizontal with the propelling blade immersed and forced against the water while the returning blade is above water encountering no resistance. The blades are alternately immersed in this fashion so that there is a net forward thrust generated.

U.S. Pat. Nos. 5,114,371 issued May 19, 1992 to Alonzo and 3,510,894 issued Jan. 14, 1969 to Eriksen describe such paddles for swimmers. They feature a mid shaft float and operate at the water surface where the return blade may also be lifted out of the water.

U.S. Pat. 4,832,631 issued May 23, 1989 to Gag describes a double bladed paddling device for undersurface swimmer use in which a crank shaft connects the blades. It is operated with a rotary motion. The blades are pivotally mounted on the crank shaft and a special clutch mechanism fixes the driving paddle and releases the returning paddle so that it will rotate to a low resistance position on the shaft. The clutch mechanism is complex and vulnerable to the corrosive effects of immersion. The operating motion is not one which takes advantage of the major upper torso muscles of a swimmer.

U.S. Pat. No. 3,557,397 issued Jan. 26, 1971 to Margolies, and U.S. Pat. No. 4,857,024 issued Aug. 15, 1989 to Evans teach a swim fin to be mounted on an individual foot with a specially shaped, horizontal blade having special flexing responses that are greater when forced through water in a first direction than in a second direction so that greater resistance is offered on the power stroke of the kick, and less on the return stroke. These, and most foot attached devices have horizontal blades requiring an up and down leg motion for best effect.

However, normal alternate arm swimming strokes cause a side to side leg motion, not an up and down motion.

U.S. Pat. Nos. 4,541,810 issued Sep. 17, 1985 to Wenzel, 4,781,637 issued Nov. 1, 1988 to Caires, and 3,934,290 issued Jan. 27, 1976 to Le Vasseur all teach a blade in which both feet mount, but the blade is horizontal.

U.S. Pat. No. 3,987,509 issued Oct. 26, 1976 to Patterman teaches a pair of vertical blades, one on each foot, with each blade having a different shape and, in combination, presenting a fin like a fish's tail.

None of the prior art teach a two bladed paddle with flexible blade features for undirectional resistance for use in combination with an apparatus mounting on both feet having a flexible vertical blade for gaining special propulsive forces from the side to side motion of the feet generated by the alternating paddle strokes.

SUMMARY OF THE INVENTION

This invention is a propulsion device for swimmers. It is designed to achieve maximum propulsive efficiency for the energy consumed using normal muscle and body motions of both arms and legs. The device consists of two parts, a paddle operated by two hands and a vertical fin operated by both feet.

The paddle has a shaft with grips for the hands. Each end of the shaft bears a blade. Each blade has a rigid leading edge portion extending forward of the shaft and a flexible trailing edge portion extending backward from the shaft. Each blade, when moving forward, lies in a plane to present minimal resistance to motion through the water. When moved backward through the water, the trailing edge of the blade curves out of the plane to either side of the plane to present resistance to motion through the water so that the swimmer's alternating arm motions pull the body forward.

The vertical fin includes two foot receiving pockets on opposed sides of the vertical fin. The fin is generally triangular in shape with a short leading edge and a broad trailing edge which may be forked and flexible to operate much as a fish's tail.

In use, the swimmer thrusts downward and backward with one arm and upward and forward with the other arm. The backward thrusting arm will deflect the flexible blade portion to provide a propulsive force while the opposite blade will provide support only. When the arms move a paddle with similar motion to that required when rowing a boat the swimmer's legs are moving side to side in reaction to the thrusting arm. By the provision of vertical fin as the extension of the feet's side to side movements of the two legs in union creates thrust in the nature of those produced by a fish's tail.

It is accordingly an object of the present invention to provide an improved water propulsion device that will assist in propelling the body of a swimmer through water at greater rate of speed and more efficiently in relation to the amount of energy consumed.

Another object of the present invention is to provide a device of very simple construction, contains flexible parts formed of resilient material only with no moving parts.

Another object of this invention is to provide a device that will be safe and can be detached from the swimmer's body at any time when needed.

A further object of the present invention is to provide a propulsion device for swimmers that, constructed using the teachings herein, can be made of a small size and light weight.

Yet another object is to provide a propulsion device of the foregoing character in which the resiliency of the material and the thickness of the cross-sectional shape of the paddle blades and flexible fin member can be controlled to produce various deflecting characteristics to determine the amount of power produced by each stroke.

A still further object of the invention is to provide a propulsion device that can be used in a wide range of water sports such as swimming, scuba diving or snorkeling.

Other advantages, features and objects of the invention will become more apparent with the teachings of the principles thereof in connection with the disclosure of the preferred embodiments thereof in the specification, claims and drawings.

BRIEF DESCRIPTION OF THE DRAWINGS

FIG. 1 is a perspective side view of the propulsion device of the invention in use.

FIG. 2 is a top perspective view of the propulsion device in use.

FIG. 3 is a front view of a portion of a paddle.

FIG. 4 is a top plan view of a portion of a paddle.

FIGS. 5A, 5B and 5C are end views of the paddle blade of FIG. 4 with increasing degrees of thrust applied.

FIGS. 6A, 6B and 6C are front views of the paddle blade of FIGS. 5A, 5B and 5C respectively.

FIG. 7 is a cross-sectional view taken along line 7—7 of FIG. 4.

FIG. 8 is a cross-sectional view taken along line 8—8 of FIG. 4.

FIG. 9 is a cross-sectional view taken along line 9—9 of FIG. 4.

FIG. 10 is a perspective view of another embodiment of a paddle of the invention.

FIG. 11 is a cross-sectional view taken along line 11—11 of FIG. 10.

FIG. 12 is a perspective view of a vertical fin assembly and waist belt connected by elastic cord.

FIG. 13 is a cross-sectional view taken along line 13—13 of FIG. 12.

FIG. 14 is a cross-sectional view taken along line 14—14 of FIG. 12.

FIG. 15 is a front elevation view of the vertical fin assembly.

FIG. 16 is a bottom view of the vertical fin assembly.

FIG. 17 is a side elevation view of the vertical fin assembly, showing the resilient blade flexing as it moves laterally.

DETAILED DESCRIPTION OF PREFERRED EMBODIMENTS

Referring now first to FIGS. 1-9, a swimmer 1 holds a paddle 2 by hand grips 3 on an intermediate portion 4 of shaft 5 having end portions 11 which support blades 7 and 8. The shaft 5 may be telescopically adjustable and taken apart at fitting 6. The shaft 5 may be non-round, of streamlined shape, for reduced hydrodynamic resistance and to resist torque applied by the asymmetrical paddle blades 7 and 8. Each blade has a rigid, short leading edge portion 9 streamlined for low resistance forward motion, and a longer trailing portion 10 which is very thin and flexible so that it will bend upward when water is forced against it as shown in FIGS. 5A, 5B, 5C.

As best seen in FIGS. 1 and 2, the swimmer uses alternating forward and backward arm strokes. Each blade, when moving forward, lies in a single plane parallel to the plane the arm is moving through to present minimal water resistance to the forward or return stroke. While the left arm of FIG. 2 is moving forward with blade 7 lying in a plane, the right arm is providing the thrust or power stroke, pulling back on blade 8 whose trailing portion 10 is forced against the water causing it to curl up out of the plane, thereby presenting great hydrodynamic resistance for a more effective power stroke.

At the same time, the lateral torso muscles of the swimmer, which are active along with the arm muscles in pulling on the paddle, cause the legs 12 to move laterally toward the pulling side of the body.

Alternating strokes thereby forcefully move the legs from side to side. This motion may be advantageously employed to aid in propelling the swimmer by means of the resilient vertical fin assembly 13. As the entire fin assembly moves from side to side, the flexible vertical fin member 14 bends first one way and then the other as best seen in FIGS. 2 and 17 with other bent shapes shown in phantom. This action corresponds in part to the propulsive action of a fish tail fin in effectively forcing the body forward in a quite different fashion than the conventional horizontal blades of swim fins which use the leg muscles. The fin assembly provides propulsion even when the leg muscles are completely relaxed or paralyzed for use by those unable to use their legs or wishing to exercise the torso muscles.

As best seen in FIGS. 12-17, the fin assembly comprises a thin, flat, resilient fin member 14 lying in a vertical plane having a generally trianguler shape with a narrow forward portion 15 having attached thereto a pair of foot receiving pockets 16, spaced apart from one another in fixed close parallel side by side relationship, with the pockets arranged so that the sole 18 of the swimmer's foot makes a 45° angle to a centerline 17 connecting the front and rear of the fin member. The rear edge 18 of the fin member may be indented at its mid point 19 to provide more of a forked tail configuration as seen in certain fish, this may reduce vibration at high speeds.

A waist band 20 is connected to vertical fin assembly 13 by elastic cord 21. The swimmer can readily slip one foot in or out of its pocket to stand in shallow water. When both feet are released, there is no danger of loss. The tether cord 21 may be shortened until it contributes to the forces pulling the fin from side to side. The vertical fin assembly may be molded in one piece of an elastomeric composition such as, for example, polyurethane, and may be provided with regions of different thickness to enhance its propulsive efficiency. As best seen in FIGS. 12-14, two thickened ridges 22 and 23 extend along upper and lower margins of the fin to help maintain the shape while permitting folding under pressure.

Considering in greater detail the construction of the paddle blades 7 and 8, the shape is generally of a trapezoidal nature with a greater dimension at the proximal edge 24 of the blades and a lesser dimension at a distal edge 25 of the blades. This configuration ensures that the greater water resistance is at a point closer to the body and resistance decreases as the lever arm increases to provide more uniform operating forces along the blade. The trailing edge 26 is not straight, but has an inward curvature which helps to prevent fluttering and vibration at high speeds.

Both blades are arranged to lie in a common plane when at rest, with the resilience of the blades and the non-round shape of the shaft maintaining that relationship. The trailing edge 26, when pulled back on the power stroke, will bend out of that plane to only one side of the plane, either upward or downward, depending upon the arm stroke.

FIGS. 10 and 11 show another embodiment in which the paddle blade 27 lies in a plane except for a very small portion 28 which is molded so as to bend out of that plane, even when there are no forces against it. This bent portion 28 acts as a pilot, ensuring that the rest of the trailing portion 10 will follow in that direction for more predictable operation under some pulling strokes such as straight back rather than down and back.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. A swimming apparatus comprising:

A) a paddle assembly for completely immersed operation, said paddle assembly comprising a shaft having a long axis, and an intermediate portion connecting two end portions, said intermediate portion arranged for gripping along said long axis by two hands of a swimmer and a pair of blades, one of said blades attached to each of said end portions, each of said blades having a thin resilient trailing portion extending rearward from said shaft in a single plane and a rigid leading edge portion coplanar with said trailing portion with both of said blades lying in a common plane when not exposed to external forces, said blades so constructed that forward, or return swimming stroke motion of one of said pair of blades, with said leading edge advancing, causes said trailing portion to remain flat in said plane for minimal hydrodynamic resistance, while the other of said pair of blades is in rearward or thrust swimming motion with said leading edge retreating which forces water against the trailing portion causing the trailing portion to bend the blade away from said single plane to only one side of said single plane for increased hydrodynamic resistance to enhance the effectiveness of alternating arm strokes; and B) a fin assembly comprising a pair of foot attaching elements for attaching to the feet of a swimmer and a thin, flat, resilient fin member directly connected to said foot attaching elements at a narrow, forward portion of said member, said fin member increasing in size as it extends rearward in the manner of a fish tail fin, said fin member lying in a vertical plane with said foot attaching elements closely juxtaposed on opposed sides of said vertical plane, said vertical swimmer into left and right halves when said foot attaching elements hold said swimmer's feet, said fin assembly arranged to maintain the feet of said swimmer in fixed, juxtaposed relationship while said feet are held in said foot attaching elements, and said fin member arranged to move from side to side for additional thrust by muscle action associated with operation of said paddle assembly.

2. The apparatus according to claim 1, in which said shaft is provided with length adjusting means.

3. The apparatus according to claim 2, in which said shaft is provided with a non-round cross section to prevent torque on said blades from rotating said shaft.

4. The apparatus according to claim 1, in which said blade has a generally trapezoidal shape with a portion adjacent said intermediate portion having a greater length.

5. The apparatus according to claim 4, in which said resilient trailing portion is more flexible at said portion adjacent said intermediate portion for reduced torque on said shaft.

6. The apparatus according to claim 1, in which said fin member has a forked trailing edge.

7. The apparatus according to claim 1, in which said fin member becomes thinner and more flexible in a rearward direction away from said foot attaching elements.

8. The apparatus according to claim 1, in which said foot attaching elements are pockets molded into one piece with said fin member.

9. The apparatus according to claim 8, in which said pockets are arranged at an angle of about 45 degrees to a centerline connecting leading and trailing edges of said fin member.

10. The apparatus according to claim 1, further comprising tether means attached to said fin assembly and connectable to a body part to prevent loss of said fin assembly.

11. A paddle assembly for a swimmer comprising:

A) a shaft having a long axis, two end portions, and an intermediate portion connecting said end portions;

B) grasping means on said intermediate portion arranged along said long axis for grasping said shaft by two hands of a swimmer; and C) a pair of blades, one of said pair attached to each of said end portions, each blade having a thin, resilient trailing portion extending rearward from said shaft in a plane and a rigid leading edge portion coplanar with said trailing portion, with both of said blades lying in a common plane when not exposed to external forces, said blades so constructed that forward, or return swimming stroke motion of one of said blades, with said leading edge advancing, causes said trailing portion to remain flat in said plane for minimal hydrodynamic resistance, while the other of said pair of blades is simultaneously in a rearward or thrust swimming stroke motion with said leading edge retreating, which forces water against the trailing portion causing the trailing portion to bend the blade away from said single plane to only one side of said single plane for increased hydrodynamic resistance to enhance effectiveness of alternating arm strokes, while both of said blades are immersed.

12. The paddle assembly according to claim 11, in which said shaft is provided with length adjusting means.

13. The paddle assembly according to claim 12, in which said shaft is provided with non-round cross section to prevent torque on said blades from rotating said shaft.

14. The paddle assembly according to claim 13, in which said blade has a generally trapezoidal shape with an edge adjacent said intermediate portion of said shaft having a greater length.

15. The paddle assembly according to claim 14, in which a portion of said blade adjacent said intermediate portion of said shaft has increased flexibility for reduced torque on said shaft.

16. The paddle assembly of claim 15, in which said increased flexibility portion includes a trailing edge bent out of said plane when no exterior forces are applied.

17. A flexible fin assembly operable when attached to both feet of a swimmer, said fin assembly comprising:

A) a pair of foot attaching elements for attaching to a swimmer's feet; and

B) a thin, flat, resilient fin member having a narrow forward portion directly attached to said foot attaching elements and a rear portion which becomes wider in extending rearward, being widest at a trailing edge in the manner of a fish tail fin, said fin member lying in a vertical plane with said foot attaching elements closely juxtaposed on opposed sides of said vertical plane, said vertical plane substantially bisecting the lower body of said swimmer into left and right halves when said foot attaching elements hold said swimmer's feet, said fin assembly arranged to maintain the feet of said swimmer in fixed, juxtaposed relationship while said feet are held in said foot attaching elements, said fin member arranged to move from side to side for additional thrust by muscle action associated with alternating swimming arm strokes.

18. The fin assembly according to claim 17, in which said foot attaching elements are pockets arranged at an angle of about 45 degrees to a centerline connecting leading and trailing edges of said fin members.

19. The fin assembly according to claim 18, further comprising tether means attached to said fin assembly and connectable to a body part to prevent loss of said fin assembly.

20. The fin assembly according to claim 17, in which said foot attaching elements are pockets molded into one piece with said fin member.

* * * * *

UNITED STATES PATENT AND TRADEMARK OFFICE

CERTIFICATE OF CORRECTION

PATENT NO. : 5,348,503

DATED : 9/20/94

INVENTOR(S) : Ryszard Fechtner

It is certified that error appears in the above-identified patent and that said Letters Patent is hereby corrected as shown below:

Column 5, line 46

In claim 1, line 36, after "vertical" insert - - plane substantially bisecting the lower body of said - -.

Signed and Sealed this

Twelfth Day of December, 1995

*Attest:*

*Attesting Officer*

BRUCE LEHMAN

*Commissioner of Patents and Trademarks*